US006253500B1

(12) United States Patent
Gyllenhammar

(10) Patent No.: US 6,253,500 B1
(45) Date of Patent: Jul. 3, 2001

(54) EXPANDABLE, MOBILE ACCOMMODATION OF ACTIVITIES

(75) Inventor: Thorbjorn Gyllenhammar, Stockholm (SE)

(73) Assignee: Innovation Development Enterprise i. Stockholm AB, Stockholm (SE)

( * ) Notice: Subject to any disclaimer, the term of this patent is extended or adjusted under 35 U.S.C. 154(b) by 0 days.

(21) Appl. No.: 09/403,456

(22) PCT Filed: Apr. 24, 1998

(86) PCT No.: PCT/SE98/00749

§ 371 Date: Dec. 2, 1999

§ 102(e) Date: Dec. 2, 1999

(87) PCT Pub. No.: WO98/49405

PCT Pub. Date: Nov. 5, 1998

(30) Foreign Application Priority Data

Apr. 25, 1997 (SE) ..... 9701578
Oct. 13, 1997 (SE) ..... 9703730

(51) Int. Cl.[7] ..... E04H 1/12

(52) U.S. Cl. ..... 52/79.5; 52/66; 52/67; 52/69; 52/71; 52/121

(58) Field of Search ..... 52/64, 66, 67, 52/69, 71, 79.5, 121

(56) References Cited

U.S. PATENT DOCUMENTS 4,135,755 1/1979 Steffens .

FOREIGN PATENT DOCUMENTS 0 109 108 5/1984 (EP) .
2 145 379 3/1985 (GB) .
WO 96/13402 10/1996 (WO) .

*Primary Examiner*—Carl D. Friedman
*Assistant Examiner*—Phi Dieu Tran A
(74) *Attorney, Agent, or Firm*—Frishauf, Holtz, Goodman, Langer & Chick, P.C.

(57) ABSTRACT

An expendable and collapsible mobile structure includes a central structure having a floor, a roof, front and rear end walls, and at least one longitudinal side wall that is movable out from the central structure. In an expansion operation, the front and rear side walls are adapted to be initially swung out perpendicular to the longitudinal side wall and positioned by ground supports. The top and bottom portions of inner sides of the front and rear side walls, moreover, are provided with rails, and top and bottom portions of front and rear side edges of the longitudinal side wall are provided with respective guide members which are movably journalled on the rails. The roof of the central structure is movable in a vertical direction and is provided with guide members that are guided along vertical rails provided on an inside of the front and rear end walls of the central structure. The roof is vertically movable between: (i) an upper position substantially flush with the top guide rails provided on the inner sides of the front and rear side walls, and (ii) a lower position in which the foldable roof sections are in a folded state and the longitudinal side wall is retracted, with the outermost roof section still being hinged to the top portion of the longitudinal side wall.

6 Claims, 5 Drawing Sheets

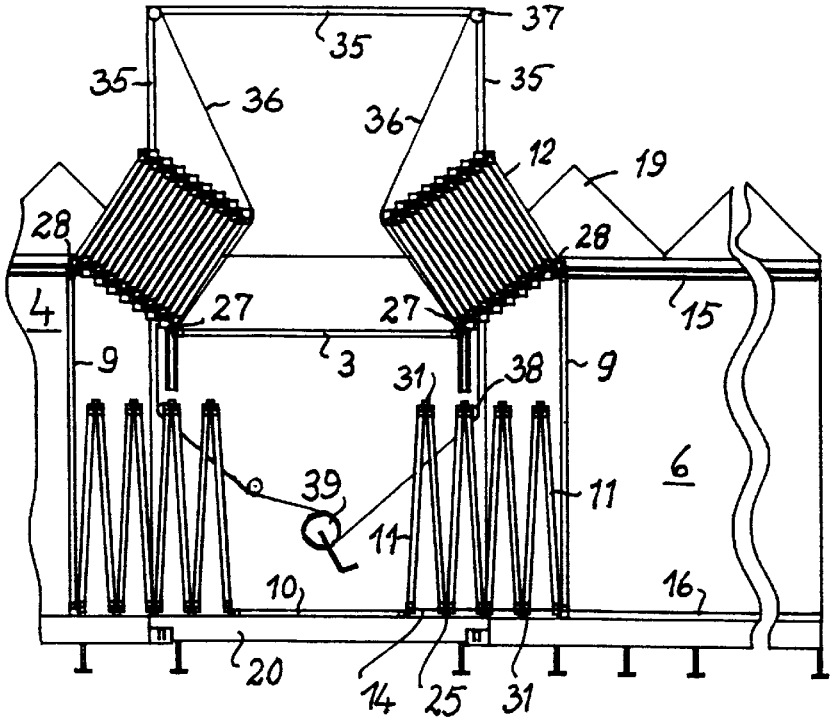
Fig. 6
Fig. 7
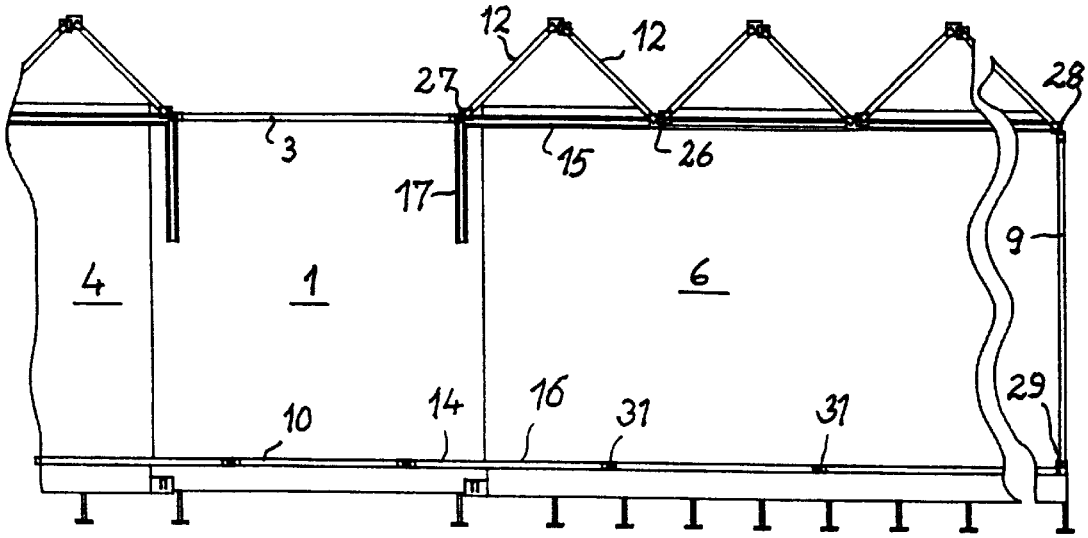

EXPANDABLE, MOBILE ACCOMMODATION OF ACTIVITIES

BACKGROUND OF THE INVENTION

The present invention relates to an expandable, rile accommodation structure.

An accomodation of this kind is known from the patent SE 9603266-9 and has proved operable in the intended way up to a specific size. One of its advantages is that it can maintain a decided width determined with a knowledge of the regulations in different countries. The maximum height is decided by the free height of viaducts to pass under. If the size of the roof sections exceeds the width of the central structure it is necessary to pile up a plurality of roof sections on the central structure, and in this case the total height easily becomes too large, which limits the size of the accomodation.

OBJECT OF THE INVENTION

The object of the invention is to provide a solution of this problem that permits the arrangement of essentially larger units in a simple way without increase of the height of transportation.

This object has been achieved in accordance with the invention in that the accomodation comprises a central structure having a roof that is arranged to be vertically adjustable so as permit foldable roof sections, in the folded state, to be kept folded like an accordion and laying with one side surface supported by the roof of the central structure when the roof is in a lowered position. The outermost roof sections are constantly joined, one of them with the roof edge of the central structure and the other with the top edge of the completely retracted, longitudinal side wall. At enlarging, the package of roof sections is pivoted around the two hinged edges during raising of the roof of the central structure and moving of the longitudinal side wall outwards until the bottom hinges of the roof sections are positioned in a horizontal level and can slide into corresponding guide rails when the roof sections are pulled apart from each other. The dimensions may be such that a plane roof is obtained, but preferably the roof sections are arranged such, that a roof having a number of identical ridges is obtained, which has a larger ceiling height and a larger mechanical strength with respect to snow load, for instance. The ceiling height is limited by the height of the walls, which, in turn, is limited by the permitted maximum height of transportation. This is a disadvantage, because there is a need of ceiling heights of up to 4–5 meters.

This problem has been solved by providing the side walls with longitudinal, hinged sections and the roof of the central structure with an extended movability in, the vertical direction, so that an essential increase of the ceiling height has been obtained in a simple way. The movability of said roof is suitably achieved by four hydraulic cylinders acting upon the roof.

BRIEF DESCRIPTION OF THE DRAWINGS

The invention will now be described in more detail with reference to the accompanying drawings, in which FIGS. 1–7 schematically show an exemplifying embodiment of an enlargeable, mobile accomodation of activities according to the present invention

DETAILED DESCRIPTION

Figure 1:
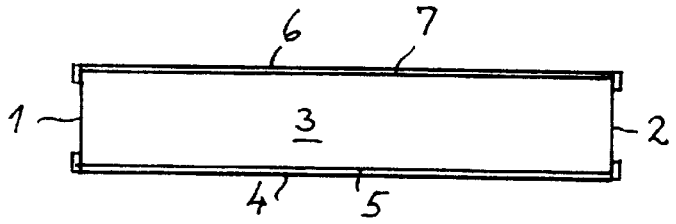
Figure 2:
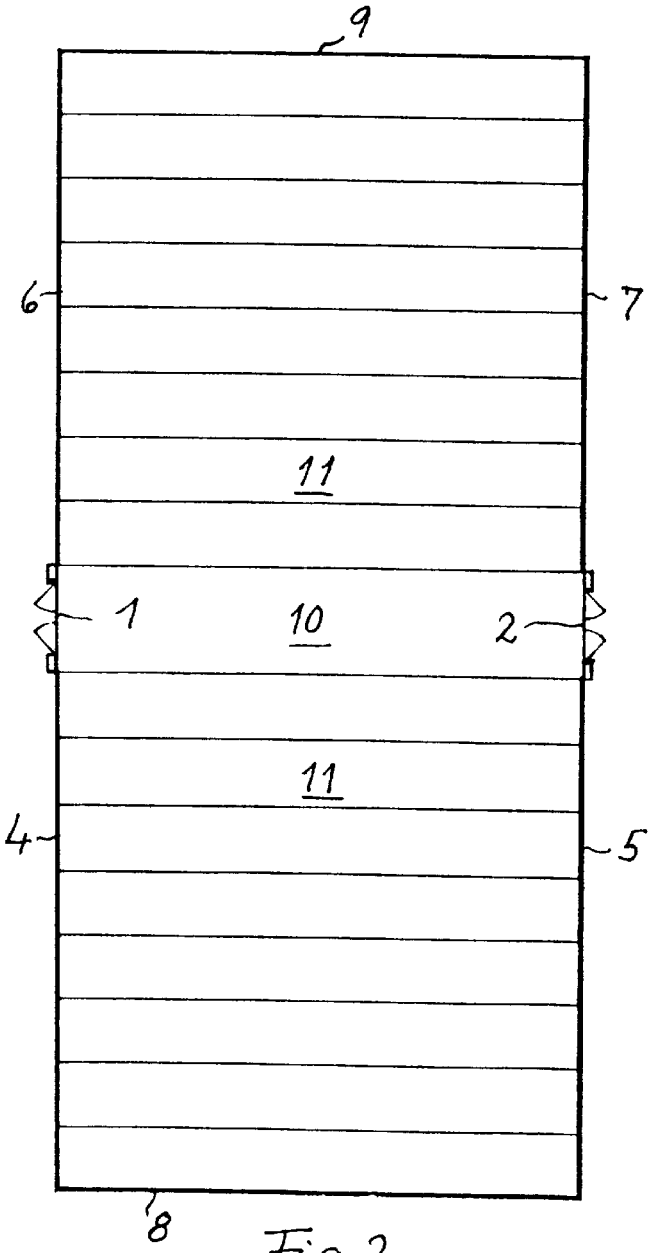
Figure 3:
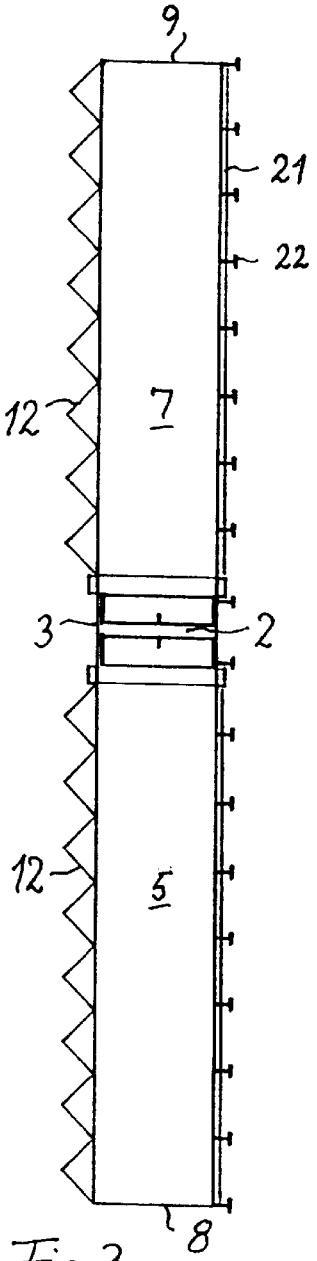
Figure 4:
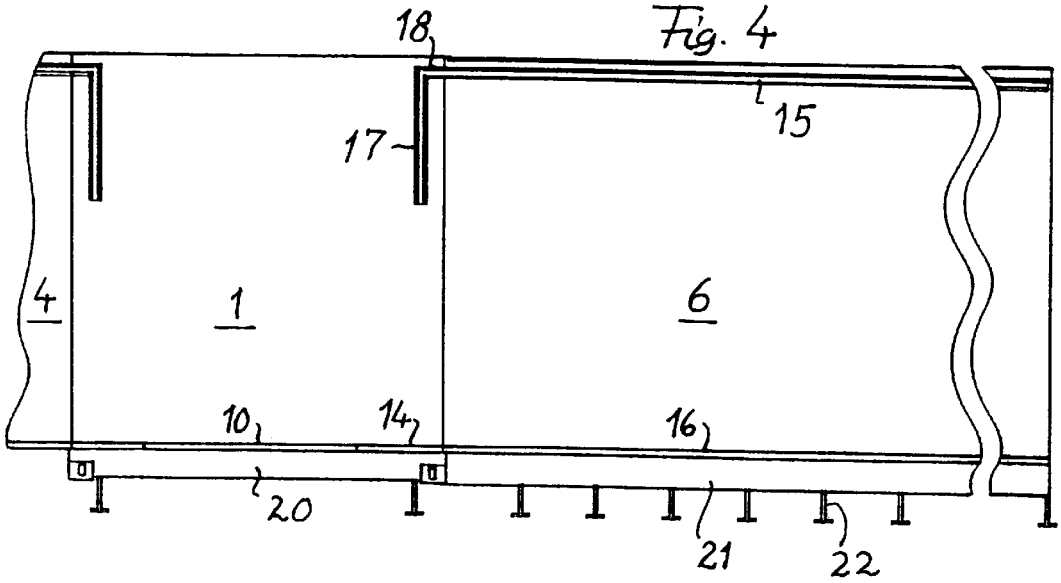
Figure 5:
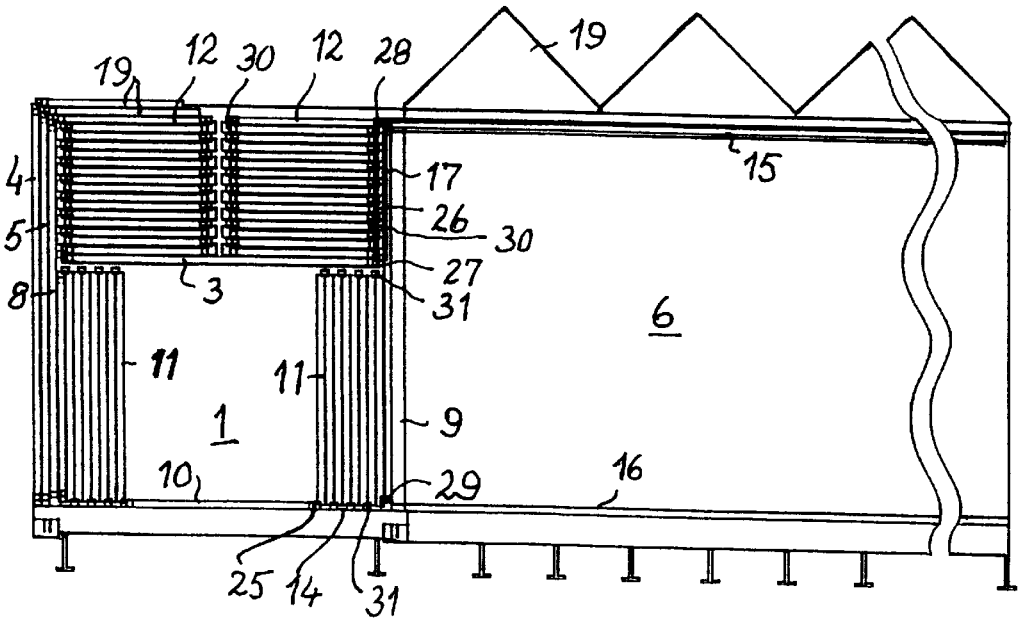
Figure 8:
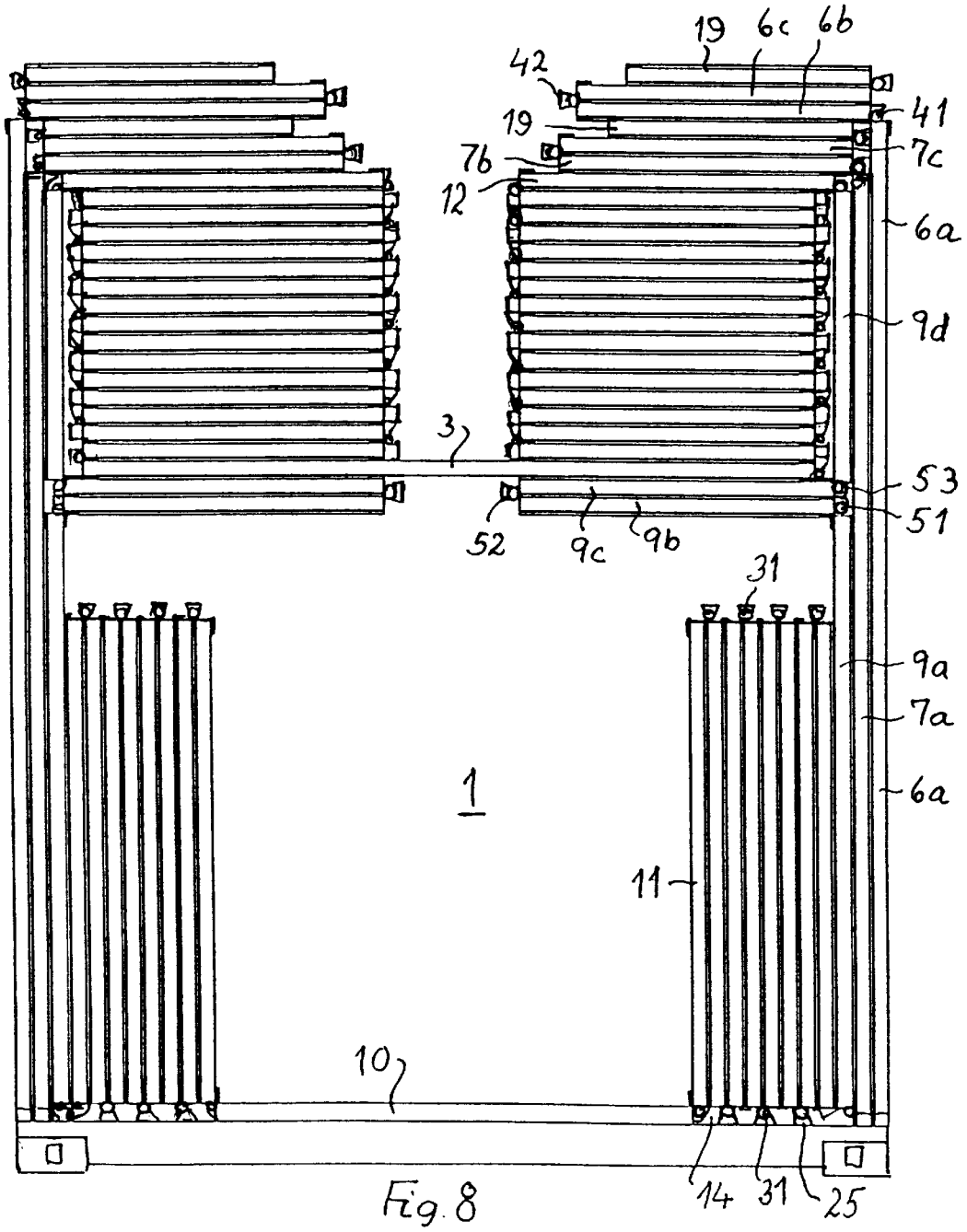
FIGS. 8 and 9 show an exemplifying embodiment of the invention having addition features.
Figure 9:
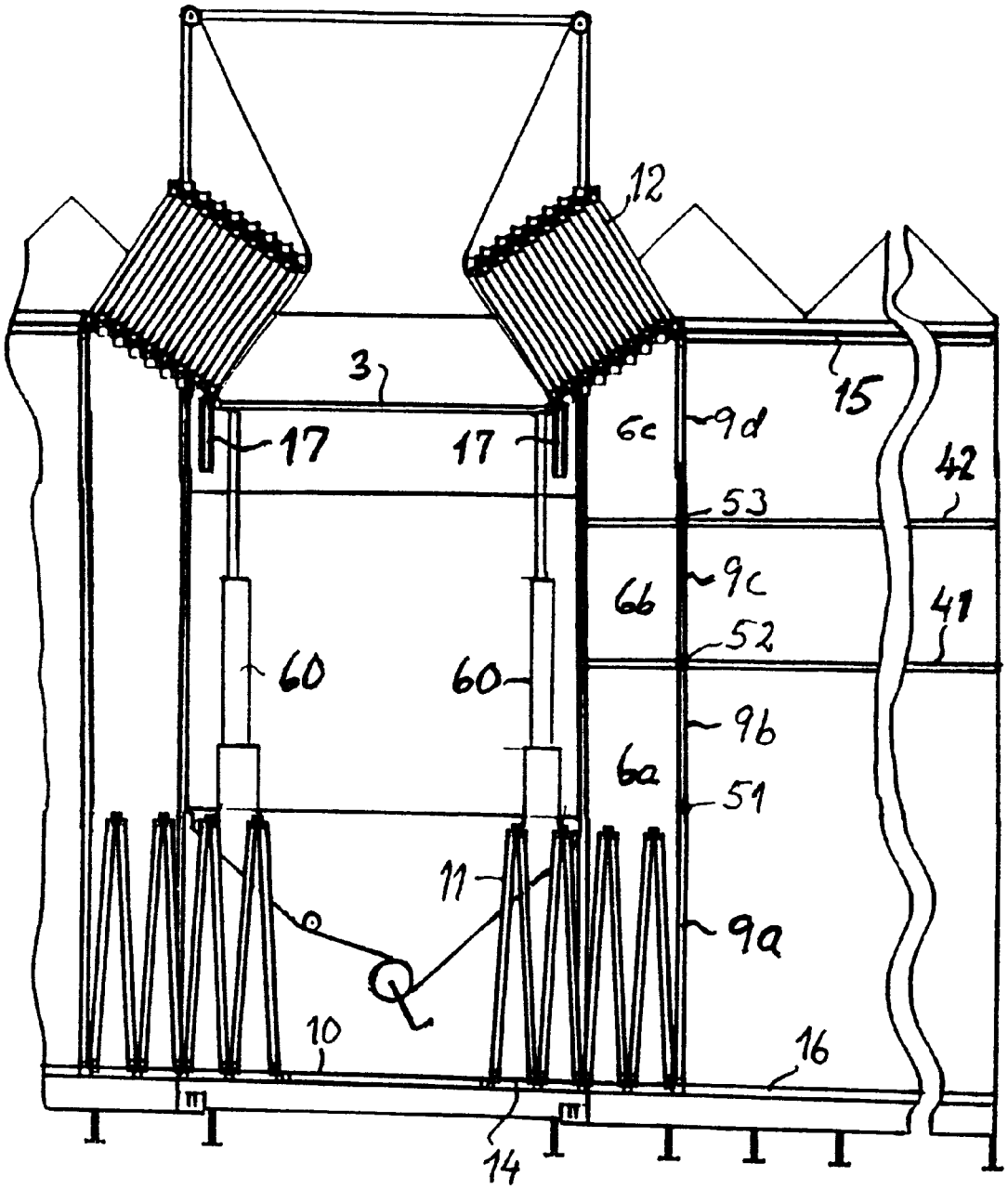

FIG. 1 is a plan view of the accomodation of activities in non-enlarged state, FIG. 2 is a view of the floor of the accomodation of activities in enlarged state, FIG. 3 is a side view of the accomodation of activities in enlarged state, FIG. 4 is an interior detail view showing the guide rails for guiding the roof sections, FIG. 5 is a view similar to that in FIG. 4 but with the roof and floor sections positioned in the central structure, FIG. 6 is the same view as FIG. 5 but with the roof and floor sections and the longitudinal side wall on the way to be folded out, and FIG. 7 is the same view as FIG. 5 and FIG. 6 but with the accomodation of activity completely enlarged. FIG. 8 is the same view as FIG. 5 and illustrates the changes necessary for obtaining this embodiment, and FIG. 9 is the same view as FIG. 6 and illustrates the operating of this embodiment in comparison with the previously suggested solution.

FIG. 1 illustrates a central structure of the accomodation according to the application as viewed from above with front and rear end walls 1,2 and a roof 3, to which end walls front and rear side walls 4 and 5, respectively, are hinged on one side of the central structure, and front and rear side walls 6 and 7, respectively, are hinged on the other side. These side walls are shown in FIG. 1 in retracted position and in FIG. 2 in folded out position perpendicular to the longitudinal direction of the central structure. Two longitudinal side walls 8,9, which in FIG. 1 were positioned inside the walls 4,5 and 6,7, respectively, are in FIG. 2 moved in parallel outwards to the positions shown. FIG. 2 also shows the floor 10 of the central structure, and folded out floor sections 11, mutually hinged to each other. The floor area of the shown example is about 300 square meters.

FIG.3 shows the rear side walls 5, 7 and a number of mutually hinged roof sections 12 that form a number of identical ridges on each side of the central structure.

Pig. 4 shows the inside of the front side wall 6 and the end wall 1. The side wall is provided with a top horizontal guide rail 15 and a bottom horizontal guide rail 16. The end wall is provided with an essentially vertical guide rail 17 and a short horizontal guide rail 18 in line with the guide rail 15. The side walls 4,5 and 7 are arranged in a corresponding way. The central structure is supported by two transverse beams 20, an the expaned parts on one or both sides of the central structure are supported by detachable, transverse beams 21 attached to the central structure. All the beams are supported by adjustable ground supports 22.

Hinged sections 19 are attached to the top edges of all four side walls 4–7, as shown in FIG. 5, with the same ridge shape as the folded out roof sections. These hinged wall sections are folded in under the roof sections 12 when these are in completely expanded state, as shown in FIG. 3.

In FIGS. 5–7 the end wall 2 and the rear side wall 7 are removed to more clearly show the roof and floor sections during their folding out to completely expanded state, as in FIG. 7. Both sides are expandable in the same way, and, hence, only the right- hand part is clearly shown here. The floor sections 11 retracted to a package are supported standing upright in the central structure inside the longitudinal side wall 9, in the completely retracted state of the floor and roof sections, FIG. 5. Guide members 25 are attached to the bottom hinges of the floor sections 11 and are positioned in the guide rail 14. The roof sections are retracted in a similar way to a package support lying down on one of its sides upon the lowered roof 3 with guide members 26 attached to the right-hand hinges on the drawing and positioned in the guide rail 17. The bottom roof section is attached by a hinge 27 to the edge portion of the roof 3, and the top roof section 12 is attached by a hinge 28 to the top edge portion of the side wall 9. The outermost floor section 11 is attached by a hinge 29 to the bottom edge portion of the side wall 9. The binges 27,28,29 and the hinges 30 connecting the roof sections and the hinges 31 connecting the floor sections all extend along the entire length of the roof and floor sections and are very sturdy to withstand all possible stressing. A suitable type of hinges are shown in the patent SE 9600625-9, which are easy to assemble and which car be provided with stop shoulders, which as to the hinges of the roof sections limit the folding out of the hinges to the positions when the roof sections are completely expanded, as shown in FIG.7.

When the accomodation of activities should be expanded it is unloaded from a truck in the dame way as is the case with a big container, if it is not provided with wheels. The beams 21, which during the transportation are carried within the central structure, are unloaded and hooked on the lateral beams 20 of the central structure, and then the beams are levelled by means of the ground supports 22. Then the side walls 4–7 are pivoted to the positions shown in FIGS. 2 and 5. The position of the side walls 4,5 and the associated wall sections 19 and the longitudinal side wall 8 before pivoting and pulling out, respectively, of said walls is shown on the left-hand part of FIG. 5.

After that a lifting device 35 is temporarily mounted on the end walls 1,2. A wire 36 is attached at each end of the hinge 27 connecting a roof section and the roof 3, which wires are extended along the underside of each package of roof sections and up to each a pulley wheel 37 and down over a further pulley wheel 38 to a lifting jack 39 on each end wall. The lifting jacks are synchronized and are driven manually or by a motor. Both packages of roof sections start turning around the hinges 28 when the lifting jacks are started at the same time as partly a guide member 26 of the top roof section is pushed into the guide rail 18 and further over to the guide rail 15, partly the wall 9, the top edge of which is connected to the hinge 28, is pushed outwards assisted by a driving means, not shown (suitably a conventional chain driving means), along the guide rails 15 and 16, such that a parallel movement of the wall 9 is accomplished. The floor sections 11 are taking part of this movement and are also moved outwards. When the package of roof sections is turned such that the roof 3 is elevated to its highest position and the guide members 26 are sliding one after the other into an opening of the guide rail 15 when the roof sections are folded out to the position shown in FIG.7. At that time also the floor sections 11 are completely pulled apart guided by the guide members 25 in the guide rail 16 to a plane position between the fixed floor 10 of the central structure and the side wall 9. The triangular parts of the wall sections 19 are eventually pushed in under the roof sections 12.

Folding of the accomodation or activities is started by the sections 19 being turned down, and push members, not shown, located right beneath the hinges 31 of the floor sections to be folded upwards are activated for a short time at the same time as said driving means (not shown) starts pulling the walls 8,9 inwards. When the roof sections 12 are packed together the roof 3 of the central structure is released and lowered, and at the same time the package of roof sections 12 is tilted over guided by the guide member 27 of the hinge between the bottom roof section 12 and the roof 3, which guide member is sliding in the guide rail 17. Men the roof 3 is in its lowest position, the walls 8,9 have reached their innermost positions, and the floor sections 11 have formed each a package inside said walls. The front and rear side walls 4–7 are pivoted to a position along the walls 8,9 with the wall sections 19 positioned on top of the roof, as shown on the left-hand part of FIG.5. The ground supports are dismounted or folded, and the beams 21 unhooked and placed in the central structure. Then the accomodation of activities is ready for transportation.

To achieve the desired increase of ceiling height of the accomodation of activities without increase of the height of transportation the following changes of the embodiment according to FIGS. 1–7 have been carried out as shown in FIGS. 8 and 9 with the same reference numerals for the same details.

The front and rear side walls 6 and 7, respectively (only the wall 6 is shown), have been provided with two longitudinal hinges 41 and 42 dividing a heightened side wall 6 into three sections 6*a*, 6*b* and 6*c*. The sections 6*b* and 6*c* are in FIG.8 folded in above the corresponding sections belonging to the side wall 7*a*, 7*b* and 7*c*, not shown. Moreover, the side walls 8 and 9, only the wall 9 is shown, are divided by three longitudinal hinges 51,52 and 53 into four sections 9*a*, 9*b*, 9*c* and 9*d*. Sections 9*b* and 9*c* are in FIG. 8 folded into the space between the roof 3 and the floor sections 11.

At expanding of the accomodation of activities the wall sections 6*a*, 6*c* and 7*b*, 7*c*, respectively, are first raised and locked in upright positions by means, not shown, and then the walls 6*a*, 6*b*, 6*c* and 7*a*, 7*b*, 7*c*, respectively, are pivoted to the position shown in FIG. 9, as previously described. The roof 3 is lifted by four hydraulic lifting jacks 60 acting on the corners of the roof 3, and the folder wall sections are raised to the position shown in FIG. 9, in which further the parallel movement outward of the wall 9*a*, 9*b*, 9*c*, 9*d* is started at the same time as the tilting of the package of roof sections 12 is started to a position for being moved out along the guide rails 15 in the previously described way.

What is claimed is:

1. An expandable, mobile structure comprising:

a central structure having a floor, a roof, front and rear end walls, and at least one longitudinal side wall that is movable out from the central structure;

a plurality of mutually hinged foldable floor sections including an outermost floor section hinged to a bottom portion of the longitudinal side wall and an innermost floor section hinged to a bottom portion of the central structure;

a plurality of mutually hinged foldable roof sections including an outermost roof section hinged to a top portion of the longitudinal side wall and an innermost roof section hinged to a longitudinal edge of the roof of the central structure;

front and rear side walls hinged to respective outermost side edges of the front and rear end walls of the central structure;

wherein in an expansion operation, the front and rear side walls are adapted to be initially swung out perpendicular to the longitudinal side wall and positioned by ground supports;

wherein top and bottom portions of inner sides of the front and rear side walls are provided with top and bottom guide rails, respectively, and top and bottom portions of front and rear side edges of the longitudinal side wall are provided with respective guide members which are movably journalled on said top and bottom guide rails; and wherein the roof of the central structure is movable in a vertical direction and is provided with guide members that are guided along vertical rails provided on an inside of the front and rear end walls of the central structure, said roof being vertically movable between: (i) an upper position substantially flush with said top guide rails provided on the inner sides of the front and rear side walls, and (ii) a lower position in which the foldable roof sections are in a folded state and the longitudinal side wall is retracted, with said outermost roof section still being hinged to the top portion of the longitudinal side wall.

2. The expandable, mobile structure according to claim 1, wherein the central structure is adapted to have a lifting device mounted thereon, and said foldable roof sections, in the folded state, are adapted to be turned around a hinge joining an edge portion of the outermost roof section to the longitudinal side wall responsive to an operation of the lifting device.

3. The expandable, movable structure according to claim 1, wherein the central structure comprises two longitudinal side walls each movable out from the central structure in an opposite lateral direction, and respective sets of said foldable floor sections and said foldable roof sections are provided for each side of the central structure, and wherein the foldable roof sections are dimensioned to be contained side by side in the folded state on the roof of the central structure when said roof is in the lower position.

4. The expandable, mobile structure according to claim 1, wherein the roof sections in an unfolded state form a plurality of ridges.

5. The expandable, mobile structure according to claim 1, wherein:

the front and rear side walls are provided with at least one wall section which is hinged by a longitudinal hinge and which, when the front and rear side walls are turned inwardly, is folded down over the roof sections in the folded state;

a central portion of the longitudinal side wall comprises two wall sections which are foldable by longitudinal hinges and which, when said longitudinal side wall is retracted, are folded into a space between the roof sections in the folded state and the roof of the central structure in the lower position; and the roof of the central structure is adapted to be lifted by a lifting device, after the at least one wall section of the front and rear side walls is raised and the front and rear side walls are swung out perpendicular to the longitudinal side wall, and until the two wall sections of the central portion of the longitudinal side wall are transferred to a planar state.

6. The expandable, mobile structure according to claim 5, wherein four corners of the roof of the central structure are adapted to have respective four hydraulic cylinders of the lifting device mounted thereon.

* * * * *